US007104937B2

(12) United States Patent
Arbuckle et al.

(10) Patent No.: US 7,104,937 B2
(45) Date of Patent: Sep. 12, 2006

(54) FOLDABLE TRANSPORTABLE MULTIPLE FUNCTION PILATES EXERCISE METHOD AND APPARATUS

(76) Inventors: Michael M. Arbuckle, 700 Zennia St., Austin, TX (US) 78751; Joseph Wieck, 1730 Gaylord Dr., Austin, TX (US) 78728; Glen E. Clifton, 14604 Goldfish Pond Ave., Austin, TX (US) 78728

( * ) Notice: Subject to any disclaimer, the term of this patent is extended or adjusted under 35 U.S.C. 154(b) by 397 days.

(21) Appl. No.: 10/027,142

(22) Filed: Dec. 26, 2001

(65) Prior Publication Data

US 2003/0119635 A1 Jun. 26, 2003

(51) Int. Cl.
*A63B 26/00* (2006.01)

(52) U.S. Cl. ..... 482/142; 21/686; 21/690

(58) Field of Classification Search ..... 482/140–142, 482/121–129, 72; D21/686, 690, 674; 446/71; 472/103; 297/1
See application file for complete search history.

(56) References Cited

U.S. PATENT DOCUMENTS

| | | | | |
|---|---|---|---|---|
| 1,621,477 | A | 3/1927 | Pilates | |
| 1,738,987 | A | 12/1929 | Dattilo | |
| 2,733,922 | A | 2/1956 | Dielio | |
| 3,770,267 | A | 11/1973 | McCarthy | |
| 4,706,953 | A | 11/1987 | Graham | |
| 4,884,802 | A | 12/1989 | Graham | |
| 5,066,005 | A | 11/1991 | Luecke | |
| 5,338,278 | A | 8/1994 | Endelman | |
| 5,364,327 | A | 11/1994 | Graham | |
| 5,607,381 | A | 3/1997 | Endelman | |
| 5,653,670 | A | 8/1997 | Endelman | |
| 5,681,249 | A | 10/1997 | Endelman | |
| 5,792,033 | A | 8/1998 | Merrithew | |
| 5,807,217 | A | 9/1998 | Endelman | |
| 5,899,834 | A * | 5/1999 | Dalebout et al. | 482/54 |
| 6,120,425 | A | 9/2000 | Endelman | |
| 6,186,929 | B1 | 2/2001 | Endelman | |
| 6,527,685 | B1 * | 3/2003 | Endelman et al. | 482/121 |
| 2004/0176227 | A1 * | 9/2004 | Endelman | |

* cited by examiner

*Primary Examiner*—Lori Amerson
(74) *Attorney, Agent, or Firm*—Rick Yeager

(57) ABSTRACT

A multi-function Pilates exercise apparatus featuring a foldable frame, a wheeled base, a rotatable pulley riser with a flexible pulley mount, gear changing apparatus and adjustable footbar. The frame is designed to fold into an upright position and to be rolled to a desired location. The pulley mount includes a section of flexible cable which permits the pulley to freely move relative to its mounting pole, thereby reducing binding during operation. The gear changing apparatus permits the user to adjust the carriage position with a single operation. The exercise system includes a reformer, pole apparatus, and a long/short box that also serves as a chair.

40 Claims, 10 Drawing Sheets

FOLDABLE TRANSPORTABLE MULTIPLE FUNCTION PILATES EXERCISE METHOD AND APPARATUS

FIELD OF THE INVENTION

This invention relates generally to the field of Pilates exercise equipment and more particularly to a machine which combines three Pilates exercise systems-reformer, pole, and chair in one footprint, and which may be folded into an upright position for storage and rolled for relocation.

BACKGROUND

The prior art includes numerous designs of Pilates type exercise equipment, beginning with the original U.S. Pat. No. 1,621,477 issued to Pilates for a wheeled platform carriage connected to a resistance device.

A reformer exercise apparatus typically includes a wheeled platform carriage which rides on parallel rails or tracks on a rectangular wooden or metal frame. Most devices employ a series of parallel springs or elastic members which connect the carriage to the foot end of the frame. The springs are manually interchangeable in order to provide a variable resistance.

The carriage typically includes stationary shoulder pads and a head rest. It is desirable to be able to convert the carriage with its raised shoulder pads and a head rest into a flat surface.

A foot bar is located at the foot end of the device so that the user can press one or both feet against the foot bar and push the carriage against the spring resistance. Adjusting the position of the carriage in relation to the foot bar is important to accommodate different body types, and is typically accomplished by manually moving a spring bar into different gear settings at the foot end of the reformer or by adjusting the foot bar position. It is desirable to provide a simple mechanism which allows for gear adjustment without requiring the user to interrupt the flow of exercise to make the necessary adjustment.

Pulleys mounted on pulley risers on support posts are often located at the head end of the reformer frame. The pulleys, themselves, are often adjustable in height during exercises where the user pulls the carriage by means of a rope or strap threaded through the pulley. The prior art pulley systems include swivel pulleys capable of accommodating ropes but not straps. Although a significant contingent of classical trained Pilates practitioners prefer the usage of flat straps, rather than ropes, the equipment typically provides only stationary, non-swivel casters or rollers when using flat straps. It is desirable to provide a fully articulating swivel pulley for straps as well as for ropes, thereby enabling the user to pull the carriage through its entire path without the binding and dragging of straps which typically occurs between the pulley and its bracket in the stationary design. It is also desirable to provide a swivel pulley which can be accommodated by a pulley riser system, and thereby allow the user to adjust the height position, as is currently available with rope systems.

Reformers are usually over 7 feet in length, and commercial models exist either as stationary units, or stackable units. The stationary units are difficult, impractical or time-consuming to move. Wheels have been added to the legs of such stationary units, but are of limited value, as they are bulky and ungainly to move, while the large amount of space required for the footprint of the unit remains the same. Stackable units typically require at least two persons to break down and stack in another location, or on a rolling cart, which then is wheeled to another location. It is, therefore, desirable to provide a device that can be folded into a minimal, space-saving footprint, which can be transported, if desired, by one individual.

It is desirable from the standpoint of economy of cost and space to provide a integrated Pilates machine which combines three Pilates machines—reformer, pole system and chair in one footprint, thus enabling the user to perform in this one machine most of the exercises in the full Pilates repertoire. In the current invention, the user can with no or very little compromise, and with ease of transition, perform exercises in the reformer mode, the pole system mode, and in a mat flat padded platform mode; and can perform a substantial number of chair exercises.

The prior art includes referenced to hinged or foldable frames. U.S. Pat. No. 3,770,267 issued to McCarthy describes an exercise machine without legs, which has a foldable frame. U.S. Pat. No. 4,706,953 issued to Graham describes an exercise machine which is collapsible by folding and by telescopic joints to make it more compact for transport and storage. U.S. Pat. No. 6,186,929 B1 issued to Endelman et al. describes a reformer apparatus with a two-part rail with a tongue connector. That patent includes a brief reference to an alternate embodiment where the tongues may include a hinged portion which permits the rail sections to be pulled apart and folded for transport.

The prior art includes references to wheels on the platform. U.S. Pat. No. 2,733,922 issued to Diego describes an exercise platform with four retractable wheels. The '929 patent describes a foldable reformer with no legs and two fixed wheels at the foot of the device.

Several prior art patents describe headrests on the carriage including the '922 patent, and U.S. Pat. No. 4,884,802 issued to Graham. U.S. Pat. No. 5,338,278 issued to Endelman describes a 4-position headrest. U.S. Pat. No. 5,681,249 issued to Endelman describes a removable headrest.

The prior art includes various footbar support designs. U.S. Pat. No. 1,738,987 issued to Dattilo describes a footbar with a pivot. The '922 patent and U.S. Pat. No. 5,066,005 issued to Luecke describe slots to adjust the footbar. The '278 patent describes a 2-way adjustment with a kick plate. U.S. Pat. No. 5,364,327 issued to Graham describes a kick plate which is adjustable along the track. U.S. Pat. No. 5,607,381 issued to Endelman describes a 2 position reversible bar on a metal frame. U.S. Pat. No. 5,653,670 issued to Endelman describes an adjustable bar and plate. The '249 patent describes a footbar which pivots for storage.

The prior art includes various designs of spring bar adjustment mechanism including the '249 patent which describes a rod and bracket, the '267 patent which describes a spring adjustment; the '987 patent; and U.S. Pat. No. 5,792,033 issued to Merrithew. U.S. Pat. No. 6,120,425 issued to Endelman describes a combination of anchor bar and carriage stop.

The prior art includes various designs of risers and pulleys including the '005 patent, the '278 patent, and the '922 patent which describes handbars. U.S. Pat. No. 3,586,322 issued to Kverneland describes an auxiliary frame. The '929 patent describes removable, non-adjustable risers.

The '249 patent describes panels on either side of carriage so that the carriage may be converted to a flat bench.

The present invention provides an attractive, durable, versatile, space-saving, and cost-saving commercial Pilates machine, which may be easily folded in to a minimal footprint and transported and stored out of the way.

SUMMARY OF THE INVENTION

The current invention features an improved Pilates machine. One embodiment of the invention includes an integrated piece of equipment which combines three Pilates machines—reformer, pole system and chair in one footprint, thus enabling the user to perform in this one machine up to 90% of the exercises of Pilates repertoire. The user can, with virtually no compromise, and with ease of transition, perform exercises in the reformer mode, the pole system mode, and a mat flat padded platform mode; and can perform a substantial number of chair exercises. One embodiment of the invention includes integrated components that, when set up, form a chair comprised of a chair pedal hinged to the wheeled base, multiple position spring attachments, and specially designed long/short box that doubles as a chair seat.

One embodiment of the invention includes the hinging of a professional-grade, heavy duty frame, so that the machine may be folded into an upright position; and a wheeled base, so that the folded upright machine may be wheeled to various locations for storage.

One embodiment of the invention includes a head rest and shoulder pad component which may be reversed by being flipped into a downward position, enabling the placement of a conversion mat on the frame to mate with the carriage pad in order to convert the reformer into flat platform mat.

One embodiment of the invention includes a gear changing mechanism located on the underside of the carriage, enabling the user to easily change the gear positions of the reformer with a simple single motion, without requiring the user to interrupt the flow of exercise by getting off the reformer to make the necessary adjustment.

One embodiment of the invention includes a fully articulating swivel pulley for both ropes and flat straps, thereby enabling the user to pull the carriage through its entire path without the binding and dragging which typically occurs with flat straps, between the pulley and its bracket in the stationary design.

One embodiment of the invention includes a mechanism which may be easily rotated in three positions to serve as an adjustable mechanism to which either the rope or strap pulleys are attached for use when in the reformer mode, as a support mechanism for the attachment of the chair springs when in the chair mode, and for out of the way storage when utilized in the pole system mode with the conversion mat in place.

BRIEF DESCRIPTION OF THE DRAWINGS

The Invention may be more easily understood, and its benefits would become more apparent, with the viewing of the following figures.

DETAILED DESCRIPTION OF THE INVENTION

Figures 1, 2:
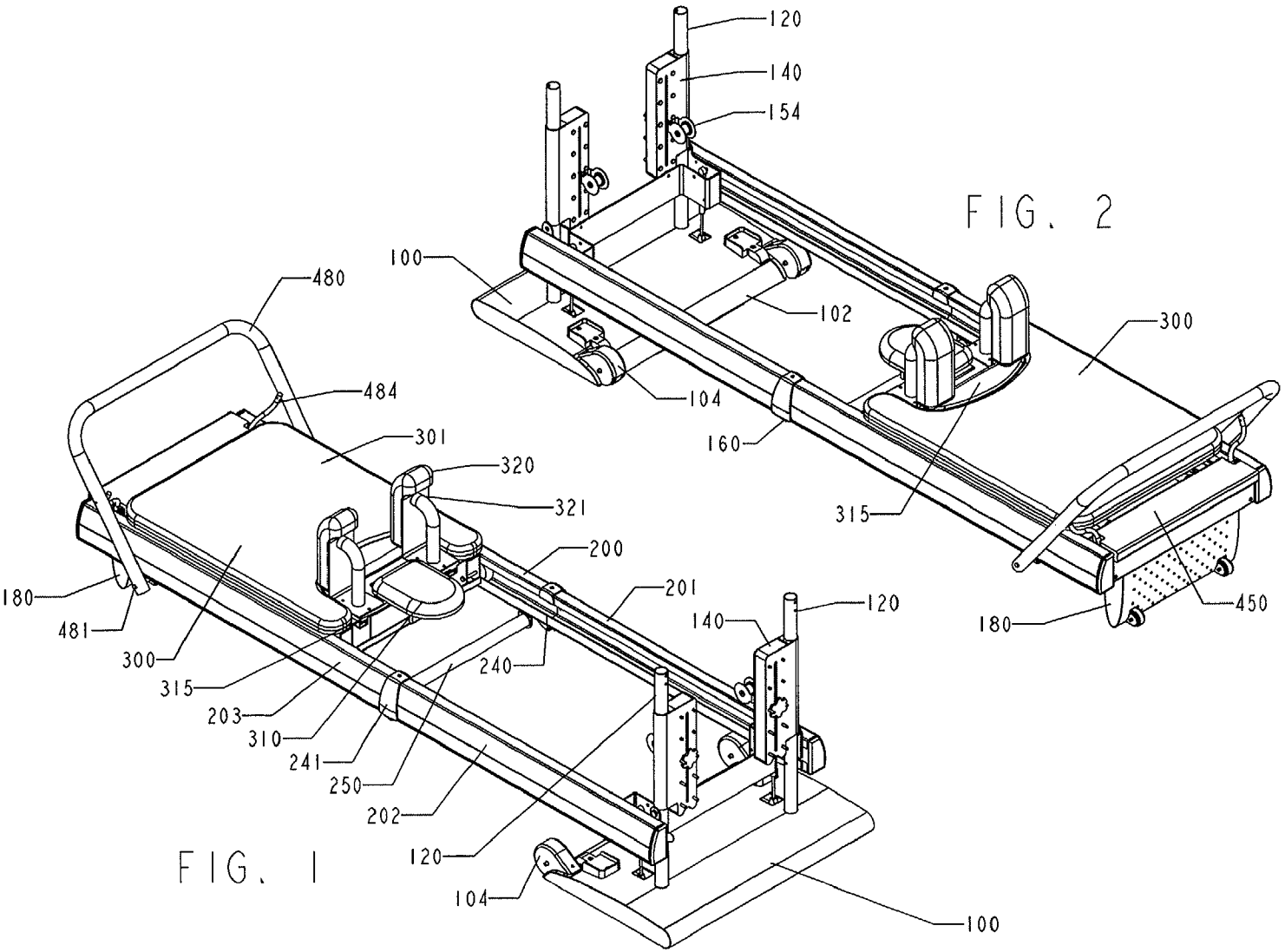
FIG. 1 is a perspective view from the front of an extended reformer in a normal position.
FIG. 2 is a perspective view from the rear of an extended reformer in a normal position.

Referring now to FIG. 1, which is a perspective view from the front of an extended reformer in a normal position and to FIG. 2, which is a perspective view from the rear of the extended reformer, the reformer includes a sliding carriage 300, with a head rest and shoulder stop assembly 315. The head rest and shoulder stop assembly includes a head rest 310 and shoulder pads 320. The platform slides along a right rail comprised of two sections, a rear section 200 and a front section 201; and a left rail comprised of two sections a rear rail section 202 and a front section 203. In one group of exercises, the user lies or sits on the carriage and pushes one or both feet against a foot bar 480 which may be positioned into various angles with an adjustable support bar 484 and a mounting bracket not shown. The rails are supported by a foot base 180 and a head base 100. The head base includes wheels 104 and head base poles 120.

In another set of exercises, the user typically pulls the platform by means of a rope, cable or strap through pulleys 154 which are each mounted on a rotatable risers 140. The user pulls the straps through the pulleys lying supine or prone, standing, or sitting on the carriage, facing back, front, or sideways, depending on the exercise. The pulley height may be adjusted as discussed below.

In another set of exercises, a chair is formed by positioning a box partially over rail sections 201 and 202.

The reformer may be folded into an upright position by lifting up on the lift handle 250, which also acts as a stabilizing bar between rail sections 200 and 203. The lift handle is raised until the base 180 is pulled over the inclined face 102 of the head base 100. The folding of the rails is assisted by head rail hinges 260 which permit rail sections 201 and 203 to rotate with respect to the head base poles 120.

The headrest can adjust to lie flat or incline with respect to the carriage surface. The headrest and shoulder pads are constructed as an integrated assembly and is hinged to the carriage platform so that it may be rotated 180° to face downward so that a conversion mat can be inserted to convert the reformer into a flat bed. The hinged headrest and shoulder pad assembly is double locked, and can be released by pulling a disengagement cable or rod located below the headrest. After disengaging the lock, the assembly can be rotated 180 degrees downward, and a mat may be placed over the rails and the assembly area in order, so that the carriage mat and the mat provide a continuous flat surface for performing mat exercises. This assembly is an improvement over prior art where shoulder rests are typically pinned to the carriage, and must be removed to provide a flat surface.

Figures 3A, 3B, 3C:
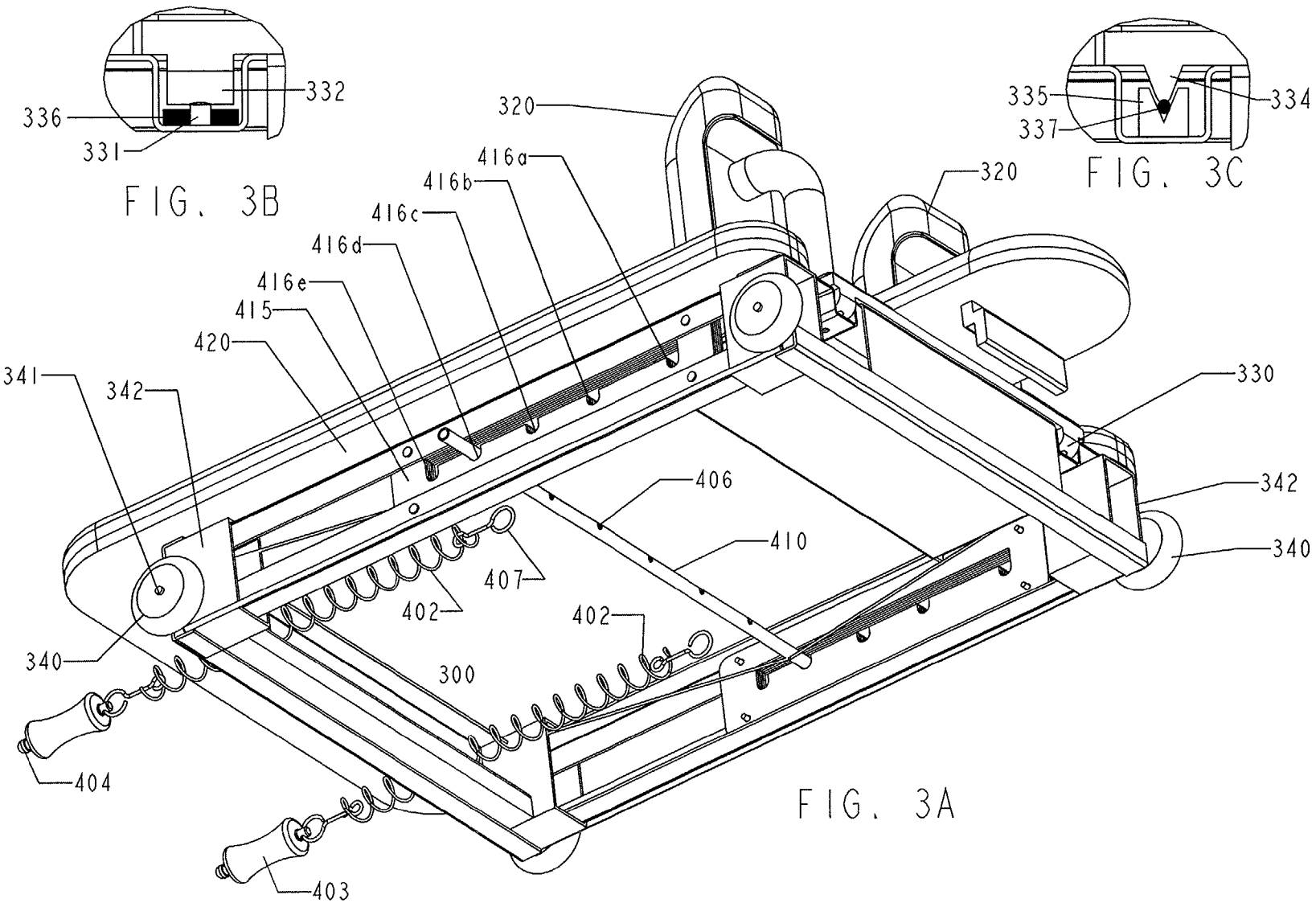
FIG. 3A is perspective view of the underside of the carriage assembly.
FIG. 3B is a detailed front cross sectional view of the carriage rope/strap channel.

Referring now to FIG. 3A, is perspective view of the underside of the carriage assembly and the underside spring mounting mechanism, the carriage rides on four carriage wheels 340, which are preferably in-line skate wheels which travel in a channel in the reformer rails. The wheel axles 341 are supported by roller brackets 342 attached to the carriage subframe 420.

The carriage resistance is provided by a plurality of interchangeable springs 402, usually three or more springs. Each spring has a spring handle 403 which has a spring retaining ball 404 which may be extended and slipped into a spring handles slot 405 (not shown) on a spring retention plate 408 (not shown) on the reformer frame near the footbar in order to set one end of the spring. The second end of each spring 407 is secured in its respective retention slot 406 on a spring gear bar 410 so that the springs are parallel to the reformer rails. A gear changer 401 (not shown) may be pulled out from the base of the carriage thereby disengaging a spring gear bar 410 so that the user may slide the carriage while remaining on the carriage.

In this embodiment, the carriage is positioned in one of 5 positions determined by the position of the spring gear bar into appropriate slots 416*a*–416*e* of spring gear bar adjustment plates 415 which are positioned on both sides of the carriage.

The slots of this embodiment include 416*c*, a one position; 416*d*, a two position; and 416*e*, a three position. These three positions 416*c*, 416*d*, and 416*e* are typical of Pilates exercise equipment. In addition to these positions, the current invention includes a novel zero position, 416*a*, which is used only in the storage and movement of the apparatus; and a minus one position, 416*b*, which is not found in prior art. In this embodiment, the 416*b* position places the carriage closer to the foot base, such that the distance from 416*b* to 416*c* is the same as the distance from 416*c* to 416*d*. This setting is typically used by persons five feet or less in height.

The distance from the carriage platform to the spring attachment box at the foot of the frame is controlled by the location of the spring gear bar on the spring gear bar adjustment plates. The spring bar typically has multiple, interchangeable tension springs attached to it. The user attaches the free end of the spring to the spring retention plate in the spring attachment box at the foot of the reformer. At least one of the four springs attached to the spring bar must be engaged when changing gears. The user changes gears while lying or sitting on the carriage by pulling on a stiff wire loop, ball, or hand grip gear changer which pulls a cable or rod is proximity to the spring bar. Pulling on the gear changer causes the cable or rod to disengage the spring bar from its slot and moves the spring bar into a neutral position that allows the user to move the carriage forward or back, thereby engaging the spring bar in another position on the ratchet plate when the gear changer is released.

The carriage position corresponding to the spring bar position is marked on the side of the frame. Taller users generally use a position where the carriage platform is further away from the spring attachment box; shorter users generally use a position where the carriage platform is closer to the spring attachment box. There is also a "parked" position 416*a*, in which the carriage platform is adjacent to the spring attachment box. This is the position the carriage platform should be in before folding the reformer.

FIG. 3A also shows the rope or strap retaining bracket 330. In some exercises, the user pulls the carriage toward the head of the reformer with straps or ropes that are wrapped around pulleys secured to risers on the head base poles at the head of the reformer. One end of these ropes or straps typically includes a hand grip, and the other end is positioned in the retaining brackets 330 after wrapping the strap or rope around the pulleys.

Referring now to FIG. 3B which is a detail of the strap retainers 332 which are secured in the retaining bracket 330, the strap 336 has regularly spaced holes, and one of the holes may be selected to fit over a strap retaining pin 331. The strap position is changed by lifting the headrest assembly and selecting another length. When the headrest is lowered back into position, the headrest presses against the strap and holds it in position over the retaining pin.

Referring now to FIG. 3C which is a detail of the rope cleats 335 which are secured in the retaining bracket 330, the desired rope length is selected, and the rope 337 is pressed into the cleat, which may be a sailboat cleat. The rope position is changed by lifting the headrest assembly, pulling the rope upwards out of the cleat, readjusting the length, pressing the rope into the cleat, and lowering the headrest back into position. The headrest presses against the strap and a rope retainer 334 holds the rope in position in the cleat.

Figure 9:
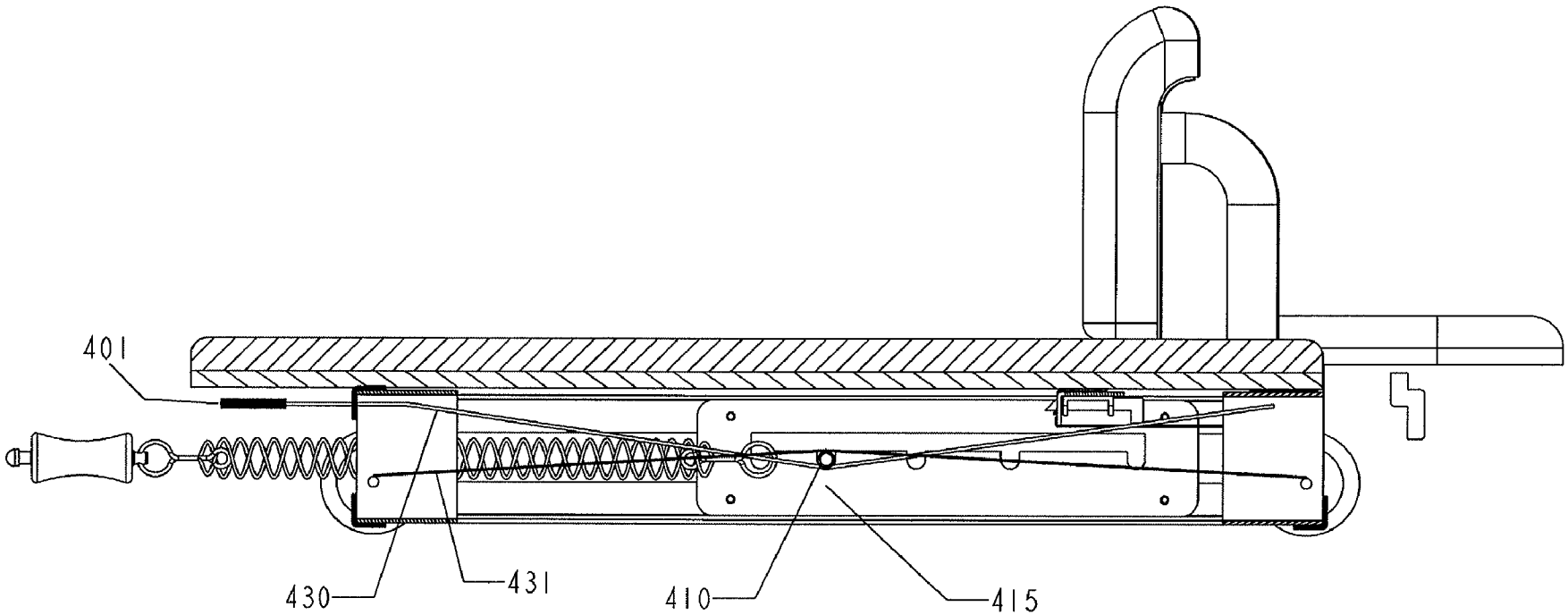
FIG. 9 is a side cross sectional view of the carriage showing the gear bar and spring adjustment mechanism.

Referring now to FIG. 9, which is a side cross sectional view of the carriage showing the gear bar and spring adjustment mechanism, the spring gear bar 410 is held in a slot on the spring gear bar adjustment plates 415 by a retaining spring 431. The spring gear bar may be disengaged from the slot by a disengagement member 430. In one embodiment, that disengagement member is a cable with a loop 401, or other handle, which may be pulled by the user from the rear of the carriage. Alternately, the cable may be replaced with a solid rod or other apparatus which causes the gear spring bar to the released from its retention slot.

Figure 5:
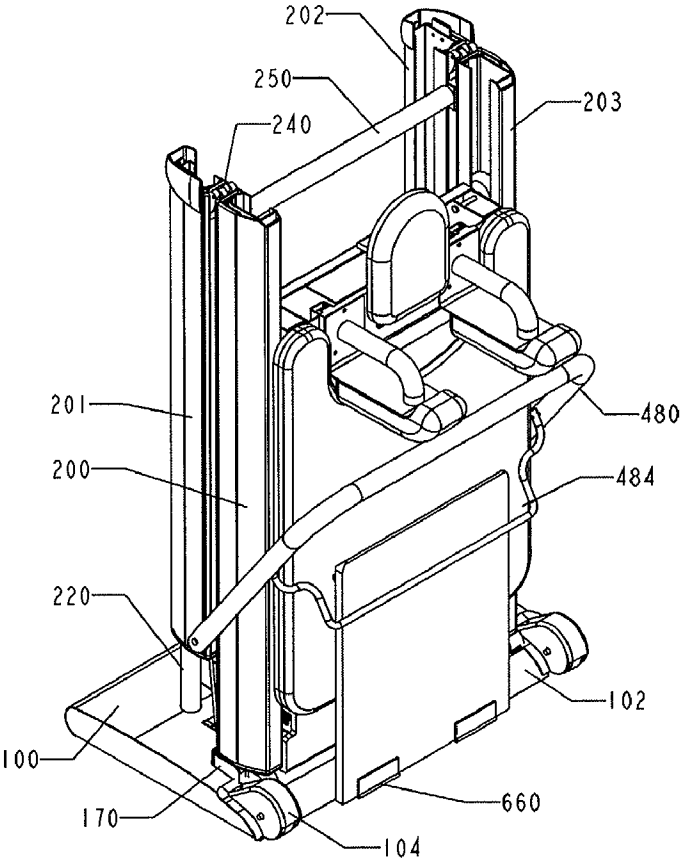
FIG. 5 is a rear perspective view of a folded reformer.
Figure 4:
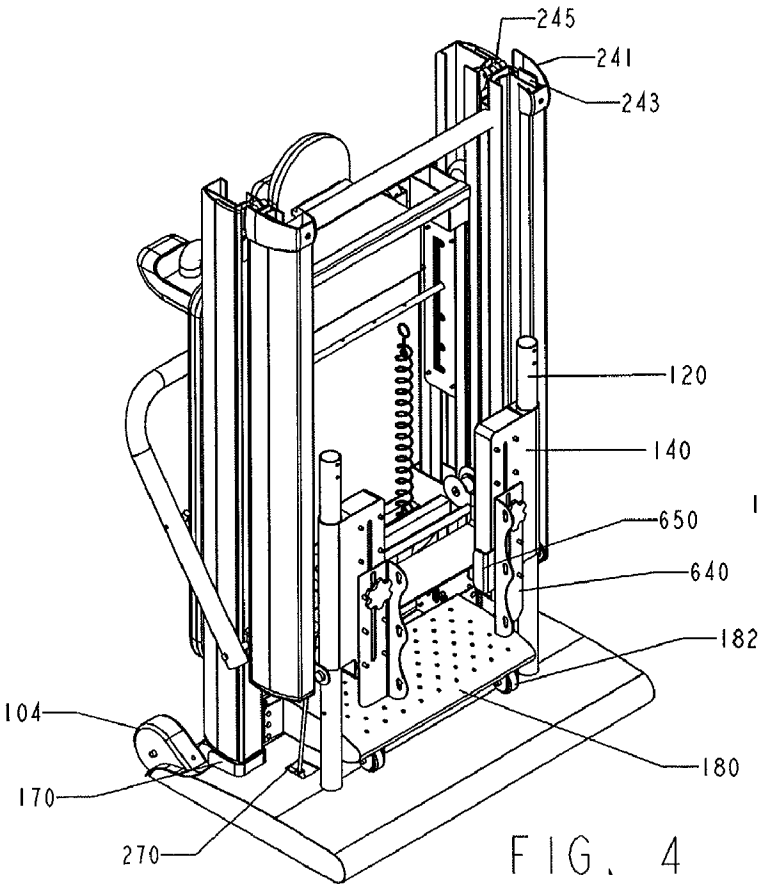
FIG. 4 is a front perspective view of a folded reformer.

Referring now to FIG. 4, which is a front perspective view of the folded reformer and to FIG. 5 which is a rear perspective view of the folded reformer, each reformer rail may be folded along a middle hinge 240 located between the frame rail sections on each rail so as the rails are folded, foot base rollers 182 on the base support roll up the front incline surface of the head base until the unit is snapped into a closed position with the rail sections resting in base rail supports 170. One or more gas cylinders 270 provides lifting assistance. The unit can then be tilted backwards slightly and rolled with head base wheels 104 in order to cart the equipment to storage or another location. The rotatable risers 140 have been rotated 90° on the head base poles 120 in order to provide room for the rear rail sections to fold upward. In this embodiment the wheels are preferably roller blade or inline roller wheels. Finger guards 241 cover the hinges 240 as the unit is raised and lowered.

Figure 10:
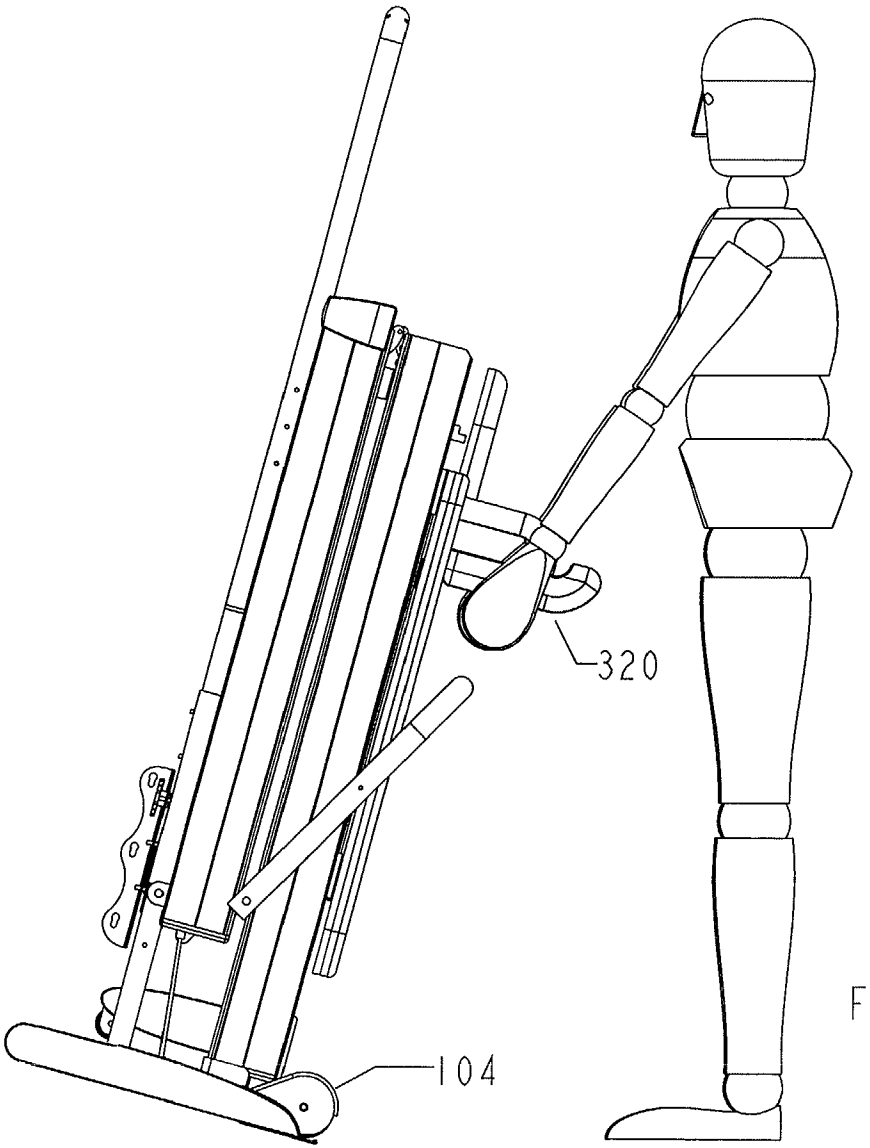
FIG. 10 is a side view of a tilted folded reformer.

Referring now to FIG. 10, which is a side view of a tilted folded reformer, the unit has been tilted back on its base wheels 104 so that it can be moved. The shoulder pads 320 provide convenient handles for moving the folded reformer.

Figure 11:
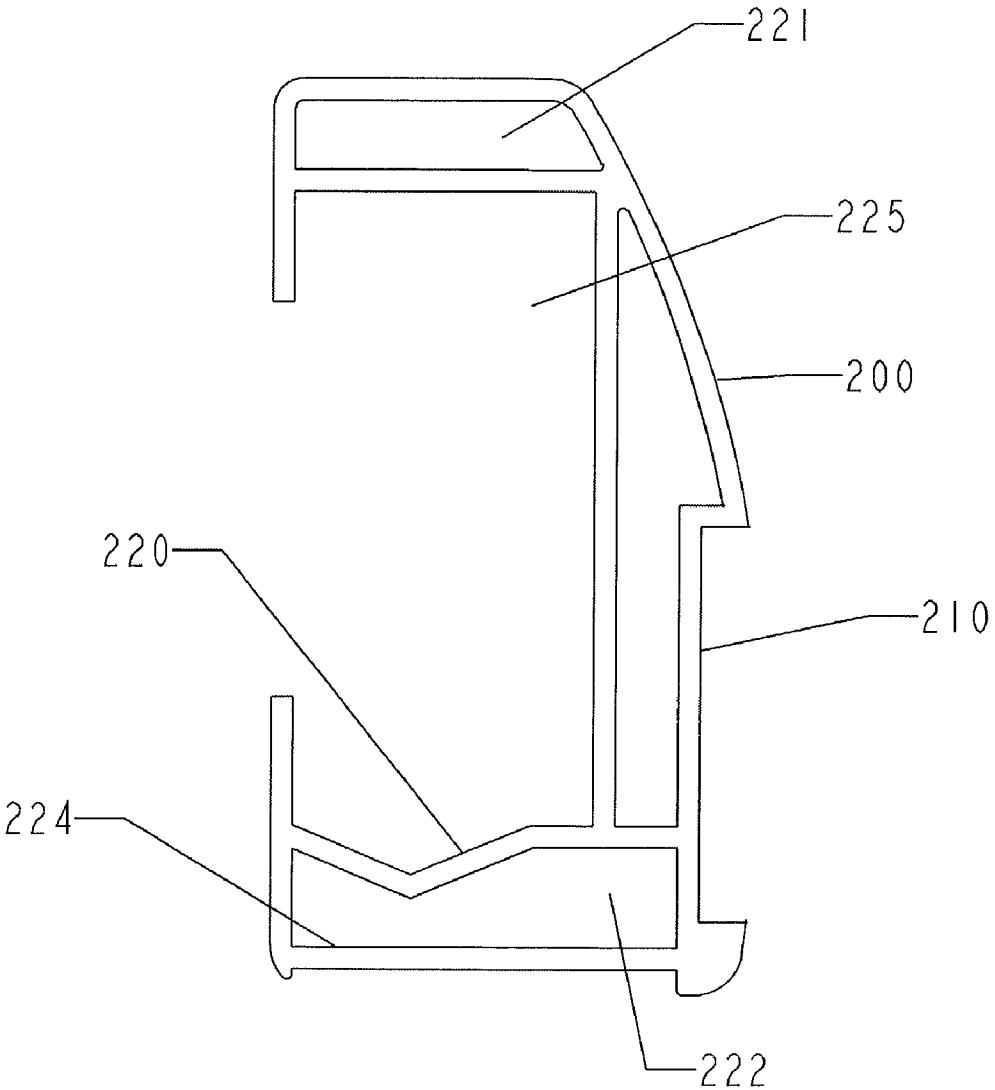
FIG. 11 is a cross sectional view of a rail member.

Referring now to FIG. 11 which is a cross sectional view of a rail member, the frame sections 200, 201, 202, and 203 are preferably extruded aluminum. The exterior of the frame section includes a rail insert 210 for insertion of decorative wood or plastic trim. The carriage is supported by rollers which travel in a rail track section 205 on concave rail 220. The concave rail it typically in a "V" or "U" shaped cross section. The rail cross section includes a horizontal blade surface 224 and a vertical blade alignment surface 225 that permit horizontal vertical alignment blades 243 (not shown) and vertical alignment blades 245 (not shown) to butt those surfaces for alignment as the rails are unfolded and for reinforcement of the rail section hinged joints when the rails are it is extended into its non-folded position. The hinge provides additional alignment and support. In this embodiment the rail section includes a top cavity 221 and bottom cavity 222 which permit other elements to be bolted or screwed to the rail sections without interfering with the roller travel. The rails track section side walls may include nylon side glide strips to ensure smooth, precise tracking of the carriage in the reformer frame.

Figure 8:
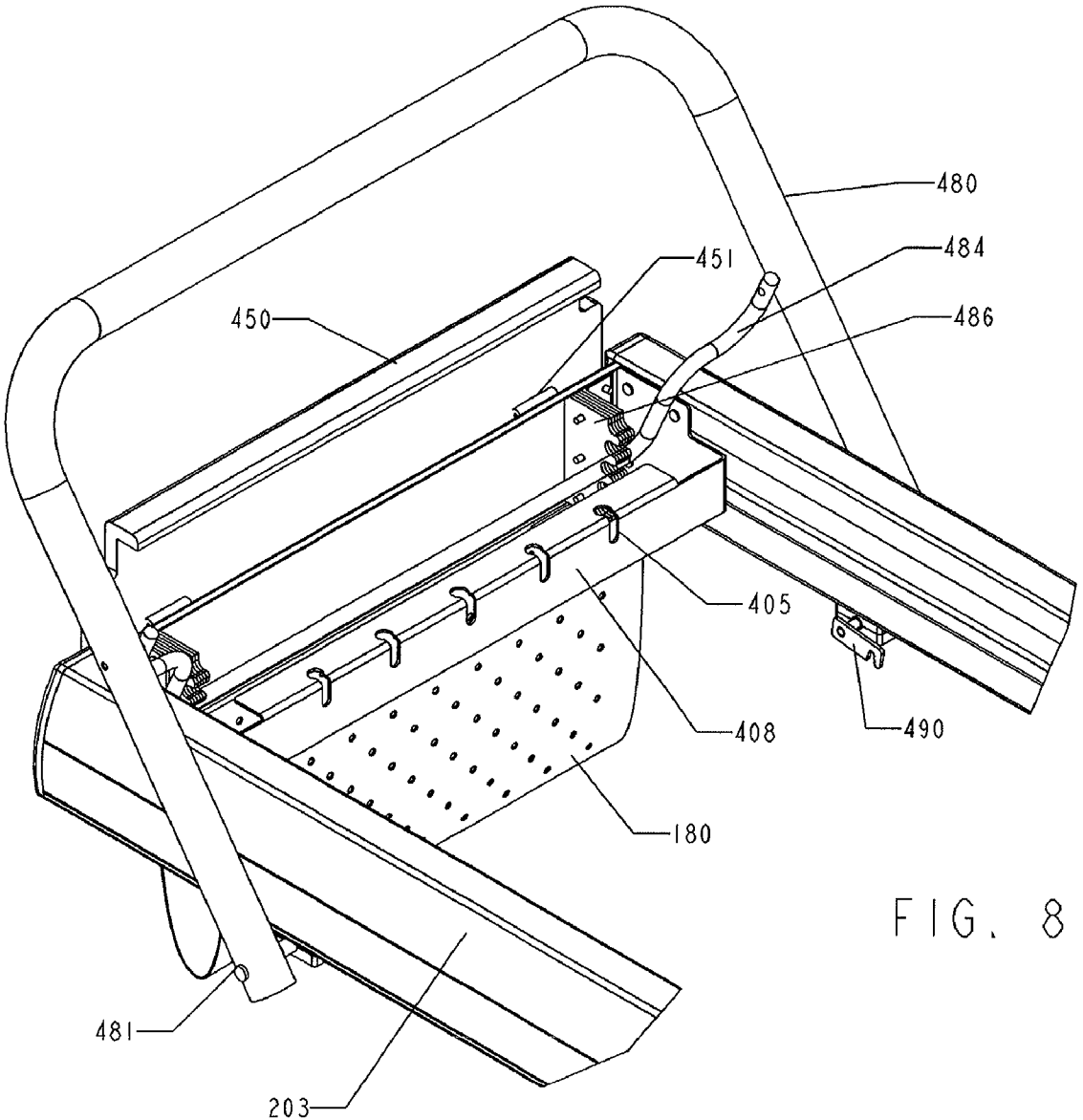
FIG. 8 is a detailed perspective view of the footbar and its adjustment bracket.

Referring now to FIG. 8, which is a detailed perspective view of the footbar and its adjustment bracket, the foot bar 480 pivots on a foot bar pivot 481 and may be positioned at various angles by moving the foot bar support 484 into one of a variety of positions with the foot bar support bracket 486. A standing platform 450 is attached by hinges 451 to the reformer frame, so that it may by raised to provide access to the footbar support bracket 486. The standing platform may alternatively be hinged at the spring retention plate so that it opens from the rear. The folding lock 490 engages a pin on the front rail section when the unit is folded in an upright position, thereby locking the unit in a folded position.

Figure 6:
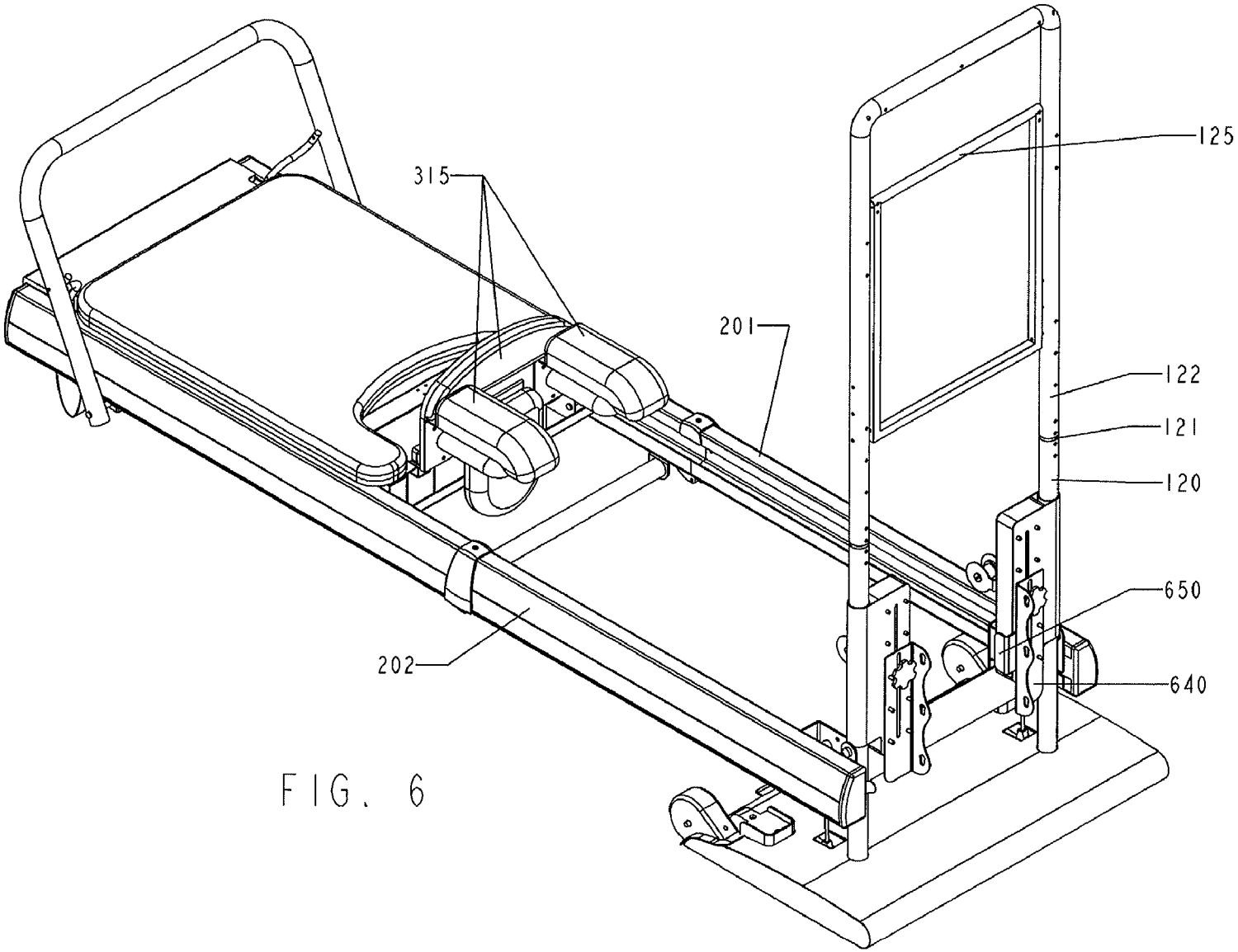
FIG. 6 is a front perspective view of a reformer with pole extensions.

Referring now to FIG. 6, which is a front perspective view of a reformer with pole extensions, additional Pilates exercises can be performed with the pole extensions 122 and the push through bar 125. The pole extensions may be secured to the base pole with head base pole bushings 121 which fit inside the ends of both the base poles and the extensions, and have spring pins to engage holes in the base poles and extensions. This view also shows the chair box bracket 650 and the chair 640 which are used with chair exercises as described below. This view also shows the headrest assembly in a partially folded-down position.

Figure 7B:
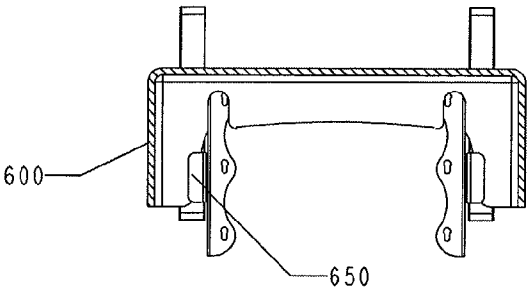
FIG. 7B is a rear cross sectional view showing the chair attachment bracket.
Figure 7A:
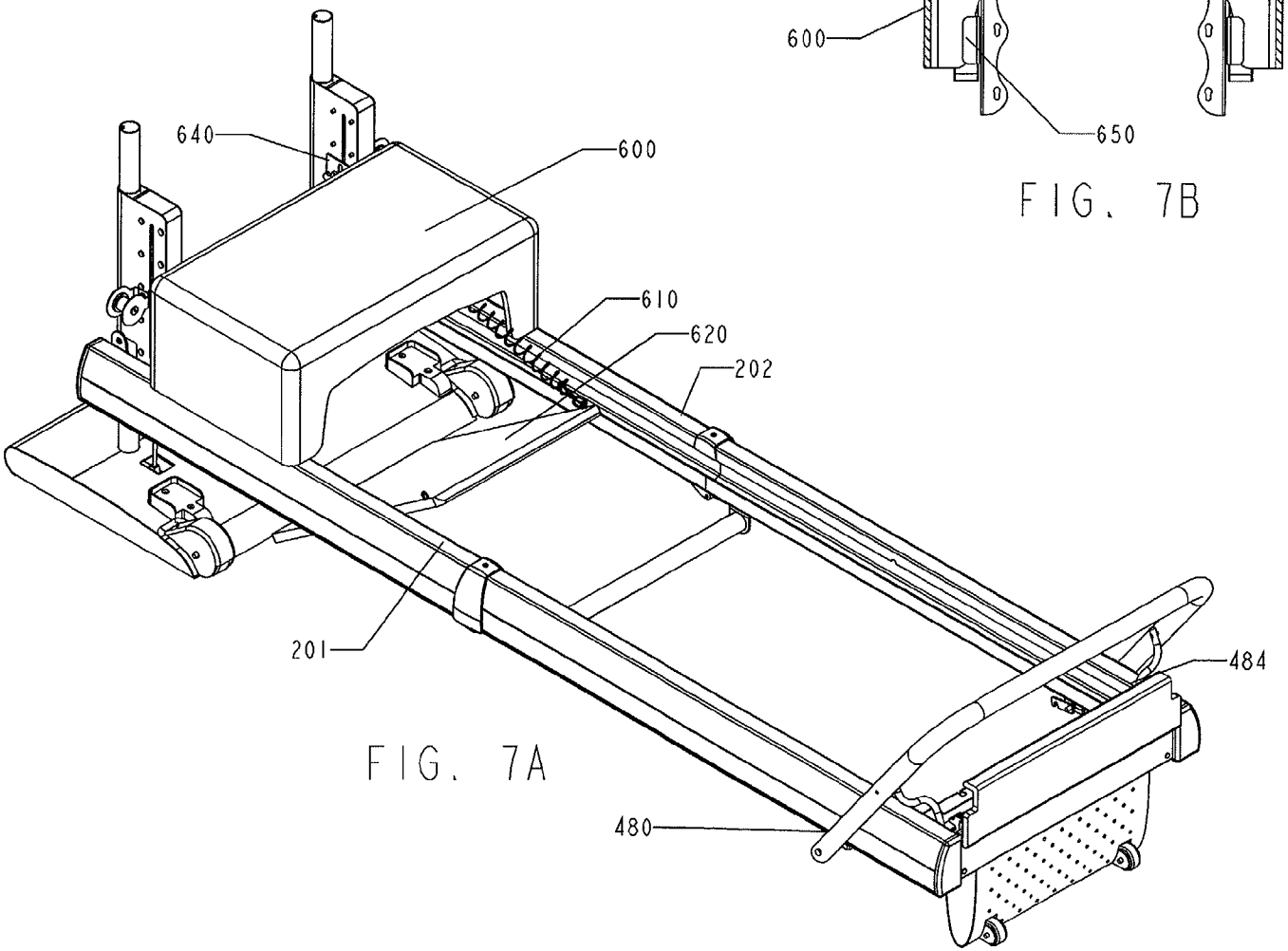
FIG. 7A is a rear perspective view of a chair on the reformer.

Referring now to FIG. 7A, which is a rear perspective view of a chair on the reformer to permit Pilates chair exercises, the chair box 600 attaches to the poles on both sides of the slide rails. The chair box, which is typically a Pilates long/short box, is placed on the carriage platform of the front rail sections. The chair box slips into a chair box bracket. Chair springs 610 are connected to the chair springs attachment plate 640 (not shown) and to the chair pedal 620 which is hinged to the head base. The position of the chair springs may be varied into a number of slots on the chair springs attachment plate 640 (not shown). The chair exercises can be preformed on the extended reformer in the chair mode or the long/short box can be easily removed to permit other exercises to be performed in that space. The chair pedal attaches to the base of the frame. Springs attach from the pedal to the chair spring attachment plate 640. The user performs exercises sitting on the chair, standing in front of it, or to either side of it. In the reformer mode, the chair box is removed and the springs are removed from the chair spring attachment plate and are secured for storage on the chair pedal.

FIG. 7B is a rear cross sectional view showing the chair box 600 secured in the chair box bracket 650. This use of the long/short box is in addition to the use of the box in the reformer mode. In the reformer mode, the box may be placed either lengthwise or crosswise on the carriage to conduct reformer exercises. In the current invention, this long/short box has been modified by removing a portion of its front and back walls to provide a path for the chair springs. This modification to the long/short box, and the use of the chair box bracket permit the long/short box to be used for both its reformer functions, and for some chair exercises.

Figure 12:
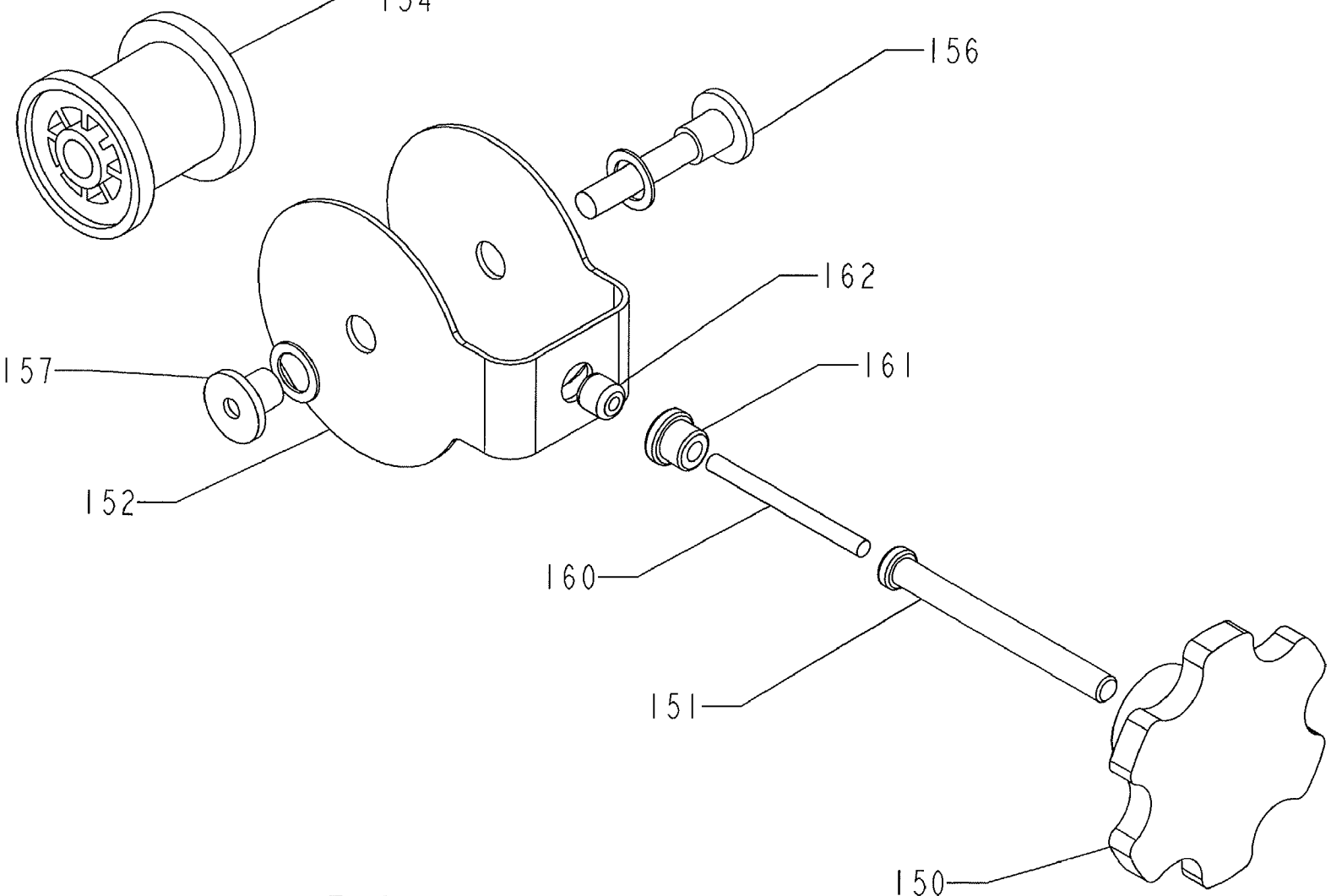
FIG. 12 is an exploded diagram of a pulley and support.

Referring now to FIG. 12 is an exploded diagram of a pulley and support, the pulley adjustment mechanism includes an adjustment slot 144 (not shown) on the pulley riser 140 (not shown) such that a pulley adjustment knob 150 may be slid up or down in the slot to change the height of the pulley and then tightened appropriately. The pulley adjustment knob has a threaded stud 151 which travels in the slot. In this embodiment, the threaded stud is connected to a ⅛ inch flexible cable 160, a pivot bushing 161 and a cable stop 162, which together act as an articulation means to permit the pulley bracket 152 to move in all directions. The articulation means permits straps to be used at various working angles without binding between the pulley roller and the pulley bracket. Other articulation means such as chain sections or eye bolts may also be used. An interchangeable pulley roller 154 may be inserted into the pulley bracket, such as a flat roller for straps or a v-type of pulley for a cord rope or cable. In this embodiment, the pulley roller is held in the pulley bracket on an axle bolt 156 and a nut 157.

Variations of the present invention will be apparent to those skilled in the art, and many of the elements described are equally suited for substitute elements. For instance, the resistance mechanism may be spring or elastic chords; the number and type of carriage support wheels may be varied; the track strap can vary; the number and type of rollers on the head base and foot base may vary; ropes, cables, and straps may be used to pull the carriage; various pulley shapes and types of hinges may be used. These and other changes familiar to those skilled in the art are anticipated in by this invention.

What is claimed is:

1. An exercise apparatus comprising:

a generally rectangular frame
- having a head end,
- a foot end,
- a hinged left rail comprising
  - a front rail section,
  - a rear rail section having a foot end, and
  - a hinge connecting the front rail section to the rear rail section, such that the left rail may be folded from an extended position substantially parallel to a floor into an upright position where the front rail section and the rear rail section are substantially vertical and the foot end of the rear rail section remains in proximity to the floor as the left rail is folded,
- and a hinged right rail comprising
  - a front rail section,
  - a rear rail section having a foot end, and
  - a hinge connecting the front rail section to the rear rail section, such that the right rail may be folded from an extended position substantially parallel to a floor into an upright position where the front rail section and the rear rail section are substantially vertical and the foot end of the rear rail section remains in proximity to the floor as the right rail is folded;

a movable carriage mounted on the frame, such that the carriage may be moved along the left rail and right rail between the head and foot ends, the carriage having a generally flat upper surface, a pair of spaced shoulder pads mounted to said upper surface and a head rest;

a plurality of spring members having a first end connected to the underside of the carriage and a second end connected to the foot end of the frame; and a foot support assembly mounted to the frame near the foot end.

2. The exercise apparatus of claim 1 further comprising an adjustable head rest, such that the head rest is adjustable to a first flat position;

a second inclined position and a third inclined position with respect to the carriage mat.

3. The exercise apparatus of claim 1 further comprising a Pilates long/short box, such that the box may be interchangeably positioned lengthwise on the carriage, in order to perform a first set of reformer exercises;

crosswise on the carriage, in order to perform a second set of reformer exercises; and lengthwise across the carriage side rails at the head of the frame, in order to perform chair exercises.

4. The exercise apparatus of claim 1 further comprising an adjustable foot support assembly.

5. The exercise apparatus of claim 1 further comprising a hinged headrest and shoulder pad assembly, such that the assembly may be rotated away and downward from the carriage surface so that a conversion mat may be positioned on the reformer frame in order to provide a flat work surface for other exercises.

6. The exercise apparatus of claim 1 further comprising a first pole section in proximity to the head of the left rail; and a second pole section in proximity to the head of the right rail.

7. The exercise apparatus of claim 6 further comprising a first pole extension section removably inserted in the first pole section; and a second pole extension section removably inserted in the second pole section.

8. The exercise apparatus of claim 6 further comprising a right adjustable and flexible pulley mechanism mounted on a right riser mounted on the first pole section, the right pulley mechanism comprising a pulley bracket support having a height adjustment means, a pulley mount a pulley roller core, and a flexible, articulating connection means between the pulley bracket support and the pulley mount, such that the pulley bracket mount may move relative to the pulley bracket support in order to reduce binding of the pulley during operation; and a left adjustable and flexible pulley mechanism mounted on a left riser mounted on the second pole section, the left pulley mechanism comprising a pulley bracket support having a height adjustment means, a pulley mount, a pulley roller core, and a flexible, articulating connection means between the pulley bracket support and the pulley mount such that the pulley bracket mount may move relative to the pulley bracket support in order to reduce binding of the pulley during operation.

9. The exercise apparatus of claim 8 wherein the pulley roller core is interchangeable to accommodate either ropes or flat straps.

10. The exercise apparatus of claim 8 wherein the flexible connection means is selected from the group consisting of a cable, two interlocking eyebolts, or one eyebolt interlocking with a mount integral to the pulley bracket.

11. The exercise apparatus of claim 8 wherein the pulley bracket is mounted on a riser such that the riser may be rotated from a first position wherein the pulleys are positioned between the pole sections and the carriage mat, so that the user may operate ropes or straps while in a reformer mode, to a second position wherein the bracket secures a box positioned on the rails when the reformer is used in a chair mode, and a third position wherein the bracket is rotated out of the way for storage when the reformer is used in a pole system mode.

12. The exercise apparatus of claim 8 wherein a riser is mounted on the pole section; and the height adjustment means comprises a slot in the riser, such that the pulley mount may be positioned at different heights in the slot.

13. The exercise apparatus of claim 1 further comprising a spring adjustment mechanism, such that the first end of the spring members are connected to a spring gear bar which tray be placed in various positions in a spring bar adjustment bracket attached to the carriage in order to adjust the distance of the carriage from the foot end, such that the various positions set the carriage at variable distances in relation to the foot bar, thereby enabling the accommodation of different body types.

14. The exercise apparatus of claim 13 wherein there are at least four carriage positions, such that three positions are Pilates one, two, and three carriage positions, and a fourth position is a negative one position, wherein the carriage is closer to the foot base than in the one position.

15. The exercise apparatus of claim 13 further comprising a plurality of markings on at least one rail, such that each marking represents a proper carriage position corresponding to spring bar adjustment bracket position.

16. The exercise apparatus of claim 13 further comprising a means for a user to change the position of the spring gear bar in the spring bar adjustment bracket without disembarking from the carriage.

17. The exercise apparatus of claim 16 further comprising a release mechanism such that the spring gear bar may be removed from a position in the spring bar adjustment bracket when the release mechanism is engaged; and a retention mechanism such that the spring gear bar may be held in a position in the spring bar adjustment bracket when the release mechanism is disengaged.

18. The exercise apparatus of claim 17 wherein the release mechanism is selected from the group consisting of at least one cable, such that pulling on the cable engages the release mechanism, and releasing the cable disengages the release mechanism; or at least one rigid bar, such that pulling on the bar engages the release mechanism, and releasing the bar disengages the release mechanism.

19. The exercise apparatus of claim 1 further comprising a left base pole located near the head end of the left rail, such that the left base pole supports the left rail front section;

a left rail front pivot means, such that the left rail front section may rotate with respect to the left base pole;

a right base pole located near the head end of the right rail, such that the right base pole supports the right rail front section; and a right rail front pivot means, such that the right rail front section may rotate with respect to the right base pole.

20. The exercise apparatus of claim 19 further comprising a foot base, the foot base including at least one wheel such that the foot base may roll toward the head as the left rail is folded along the left hinge and the right rail is folded along the right hinge; and a head base located near the head of the left rail and right rail, such that the left base pole and the right base pole are supported in the head base, and such tat the head base remains stationary while the foot base is rolled into a folded position.

21. The exercise apparatus of claim 20 wherein
the head base has at least one wheel such that once the unit is folded into a vertical folded position, the folded apparatus may be moved by rolling it on the wheel.

22. The exercise apparatus of claim 21 wherein
the foot head base has at least two wheels; and
the head base has a rear inclined face such that the wheels may be wiled up the inclined face as the unit is wiled into a vertical folded position.

23. An exercise apparatus comprising:
a generally rectangular frame having
a head end
a head end support including a head base wit at least two wheels, a left base pole and a right base pole,
a left riser mounted on the left base pole,
a right riser mounted on the right base pole,
a foot end,
a wheeled foot end support,
a left rail comprising
a left rail front section,
a left rail front section pivot support integral to the left base pole,
a left rail rear section,
a left rail hinge connecting the left rail front section and the left rail rear section, such that the left rail front section may be folded with respect to is the left rail rear section,
a right rail comprising
a right rail front section,
a right rail front section pivot support integral to the right base pole,
a right rail rear section,
a right rail hinge connecting the right rail front section and the right rail rear section, such that the right rail front section may be folded with respect to the right rail rear section;
a movable carriage mounted on the flame, such that the carriage may be moved along the left rail and the right rail between the head end and the foot end, the carriage having a generally flat upper surface, a pair of spaced shoulder stops mounted to said upper surface and an adjustable head rest
an height-adjustable and flexible left pulley mechanism attached to the left riser;
an height-adjustable and flexible right pulley mechanism attached to the right riser;
a plurality of interchangeable springs having a first end connected to a rod which may be positioned into one of several slots affixed to the underside of the carriage and a second end connected to the foot end of the frame;
a gear mechanism to assist in changing the position of the rod from one slot to another slot; and
an adjustable foot support assembly mounted to the frame near the foot end.

24. The exercise apparatus of claim 23 further comprising
a means for removably securing a Pilates long/short box over the head portion of the left rail and the right rail, thereby permitting Pilates chair exercises on the box.

25. The exercise apparatus of claim 23 further comprising
a means for inverting the headrest so that a separate mat be placed over a portion of the left rail and the right rail, thereby permitting Pilates mat exercises on the mat and carriage.

26. The exercise apparatus of claim 23 further comprising
a means for removably attaching a left pole extension on the left base pole; and
a means for removably attaching a right pole extension on the right base pole, such that a push through bar may be positioned between the left pole extension and the right pole extension, thereby permitting Pilates pole exercises.

27. The exercise apparatus of claim 23 wherein
there are a plurality of slots for carriage position adjustment.

28. An improved reformer, the improvement comprising:
a first rail comprising
a front rail section
a rear rail section having a foot end, and
a hinge connecting the front rail section and to the rear rail section, such that the first rail may be folded from an extended position substantially parallel to a floor into an upright position where the front rail section and the rear rail section are substantially vertical and the foot end of the rear rail section remains in proximity to the floor as the first rail is folded;
a second rail comprising
a front rail section,
a rear rail section having a foot end, and
a hinge connecting the front rail section and to the rear rail section, such that the second rail may be folded from an extended position substantially parallel to the floor into an upright position where the front rail section and the rear rail section are substantially vertical and the foot end of the rear rail section remains in proximity to the floor as the second rail is folded; and
a movable carriage, such that the carriage may be moved along the first rail and the second rail.

29. The improved reformer of claim 28 further comprising
a spring near bar for adjusting the position of the carriage;
a spring bar adjustment bracket; and
a disengagement member which permits a user to change the position of the spring gear bar in the spring bar adjustment bracket.

30. The exercise apparatus of claim 29 further comprising
a release mechanism such that the spring gear bar may be removed from a position in the spring bar adjustment bracket when the release mechanism is engaged; and
a retention mechanism such that the spring gear bar may be held in a position in the spring bar adjustment bracket when the release mechanism is disengaged.

31. The improved reformer of claim 28 further comprising
a rotatable pulley assembly such that ropes or straps may be pulled through a pulley from various positions of the carriage, when the pulley is at various heights, without binding.

32. The improved reformer of claim 28 further comprising
a pole assembly, the pole assembly comprising
a head base;
a right head base pole;
a left head base pole;
a right pole extension removably attached to the right head base pole;
a left pole extension removably attached to the left head base pole; and
a push through bar attached to the right pole extension and the left pole extension, such that Pilates pole exercises may be conducted on the reformer and pole assembly.

33. The improved reformer of claim 28 further comprising
a Pilates long/short box, such that the box may be interchangeably positioned lengthwise on the carriage, in order to perform a first set of reformer exercises;

crosswise on the carriage, in order to perform a second set of reformer exercises; and lengthwise across the carriage side rails at the head of the frame, in order to perform chair exercises.

34. An interchangeable Pilates exercise system comprising a reformer comprising a pair of carriage rails, and a movable carriage including a foldable headrest and shoulder rest assembly, such that the assembly may be folded to a flat position;

a pole extension assembly removably attachable to the reformer, such that pole exercises may be performed on the pole extension; and a modified long/short box, such that the box may be placed lengthwise or crosswise on the carriage for reformer exercises, or placed on the carriage rails to perform chair exercises.

35. The exercise system of claim 34 further comprising a removable mat which may be placed over the carriage rails and the folded down headrest and shoulder rest assembly to create a flat surface in conjunction with the carriage.

36. A method for storing and transporting a reformer exercise apparatus having a first rail, a first rail head section, a first rail head section support, a first rail foot section, and a first rail foot section support, and a second rail, a second rail head section, a second rail head section support, a second rail foot section, and a s second rail foot section support, the method comprising folding the reformer frame from an extended lateral position to a vertical folded position by lifting the frame near the hinged intersection of the first rail head section and the first rail foot section and near the hinged intersection of the second rail head section and the second rail foot section, rolling the first rail foot section and the second rail foot section toward the head of the reformer, pivoting the head section of the first rail on its head section support, pivoting the head section of the second rail on its head section support, continuing to roll the first rail foot section and the second rail foot section toward the head of the reformer until the reformer is in a folded vertical position;

securing the reformer into a folded vertical position;

tilting the folded reformer so that wheels on the right and left head section supports contact the floor;

rolling the folded reformer to a desired position; and tilting the reformer back into a vertical position.

37. An exercise apparatus, for placement on a support surface, the exercise apparatus comprising:

a generally rectangular frame having a head end, a foot end having at least one foot base roller, a hinged left rail and a hinged right rail, each rail comprising a front section having a first end pivotally attached to the head end of the frame, and a second end connected to a hinge, and a rear section having a first end connected to the hinge, and a second end attached to the foot end, such that each rail may be folded at its hinge, and such that the second ends of the rear sections are supported by the foot base roller and remain in proximity to the support surface as the rails are folded;

a movable carriage mounted on the frame, such that the carriage may be moved along the left rail and right rail between the head and foot ends, the carriage having a generally flat upper surface, a pair of spaced shoulder pads mounted to said upper surface and a head rest;

a plurality of spring members having a first end connected to the underside of the carriage and a second end connected to the foot end of the frame; and a foot support assembly mounted to the frame near the foot end.

38. An exercise apparatus comprising:

a generally rectangular frame having a head end, a foot end, a left rail having a head end and a foot end, and a right rail having a head end and a foot end;

a movable carriage mounted on the frame, such that the carriage may be moved along the left rail and right rail between the head and foot ends, the carriage having a generally flat upper surface, a pair of spaced shoulder pads mounted to said upper surface and a head rest;

a plurality of spring members having a first end connected to the underside of the carriage and a second end connected to the foot end of the frame;

a foot support assembly mounted to the frame near the foot end;

a first pole section in proximity to the head end of the left rail, and a second pole section in proximity to the head end of the right rail, each pole section comprising a rotatable riser, such that the riser may be set at a first position oriented between the pole sections, and set at a second position, the second position being rotated away from the first position and away from the rails.

39. The exercise apparatus of claim 38 further comprising a first pole section in proximity to the head end of the left rail, and a second pole section in proximity to the head end of the right rail, each pole section comprising a rotatable riser, such that the riser may be set at a first position oriented between the pole sections, and set at a second position, the second position being rotated away from the first position and away from the rails, and a vertically adjustable pulley mechanism mounted on the riser, such that the pulley mechanism may be set at a desired height relative to the riser, and such that a user may perform a first set of exercises with the pulley mechanisms;

a removable first pole extension section, such that the first pole extension section may be secured to the first pole section, and a removable second pole extension section, such that the second pole extension section may be secured to the second pole section, such that the user may perform additional exercises with the pole extension sections.

40. An exercise apparatus comprising:

a generally rectangular frame having a head end, a foot end, a left rail having a head end and a foot end, and a right rail having a head end and a foot end;

a movable carriage mounted on the frame, such tat the carriage may be moved along the left rail and right rail between the head and foot ends, the carriage having a generally flat upper surface, a pair of spaced shoulder pads mounted to said upper surface and a head rest;

a foot support assembly mounted to the frame near the foot end;

a plurality of spring members having a first end connected to the underside of the carriage and a second end connected to the foot end of the frame; and a spring adjustment mechanism, such that the first end of the spring members are connected to a spring gear bar which may be placed in various positions in a spring bar adjustment bracket attached to the carriage in order to adjust the distance of the carriage from the foot end, such that the various positions set the carriage at variable distances in relation to the foot bar, thereby enabling the accommodation of different body types.

* * * * *